US008827390B2

(12) United States Patent
Wehner et al.

(10) Patent No.: US 8,827,390 B2
(45) Date of Patent: Sep. 9, 2014

(54) APPLIANCE WITH FEATURES FOR FACILITATING ACCESS TO A CONTAINER

(71) Applicant: General Electric Company, Schenectady, NY (US)

(72) Inventors: Ross Benson Wehner, Austin, TX (US); Ronald Scott Tarr, Louisville, KY (US); Raymond James VanAssche, Louisville, KY (US); Joseph Emil Gormley, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/742,027

(22) Filed: Jan. 15, 2013

(65) Prior Publication Data

US 2014/0021847 A1 Jan. 23, 2014

Related U.S. Application Data

(63) Continuation-in-part of application No. 13/552,991, filed on Jul. 19, 2012.

(51) Int. Cl.

| | |
|---|---|
| ***A47B 96/04*** | (2006.01) |
| ***A47B 95/02*** | (2006.01) |
| ***A47B 57/00*** | (2006.01) |
| ***A47B 95/00*** | (2006.01) |
| ***F25D 25/02*** | (2006.01) |
| ***A47B 96/00*** | (2006.01) |
| ***F25D 23/02*** | (2006.01) |
| *A47B 88/00* | (2006.01) |

(52) U.S. Cl.

CPC ..... *F25D 23/028* (2013.01); *A47B 2210/175* (2013.01); *A47B 2088/0081* (2013.01); *F25D 25/025* (2013.01); *A47B 96/00* (2013.01)

USPC ..... 312/405.1; 312/319.1; 312/319.8; 312/306

(58) Field of Classification Search

USPC ..... 312/405.1, 402, 404, 306, 312, 298, 312/301, 310, 319.1, 319.5–319.8, 325, 312/246, 247

See application file for complete search history.

(56) References Cited

U.S. PATENT DOCUMENTS

| | | | | |
|---|---|---|---|---|
| 2,547,513 | A * | 4/1951 | Wikman | 109/53 |
| 5,020,868 | A * | 6/1991 | Brunnert | 312/319.1 |
| 5,115,822 | A * | 5/1992 | Nichols | 134/135 |
| 5,244,269 | A * | 9/1993 | Harriehausen et al. | 312/247 |
| 5,567,028 | A * | 10/1996 | Lutovsky et al. | 312/246 |
| 5,946,953 | A * | 9/1999 | Feldpausch | 70/78 |
| 6,886,781 | B2 * | 5/2005 | Lau et al. | 244/118.1 |
| 7,396,093 | B2 | 7/2008 | Jeong et al. | |
| 7,587,907 | B2 | 9/2009 | Kim et al. | |
| 7,600,830 | B2 | 10/2009 | Oh et al. | |
| 7,628,461 | B2 | 12/2009 | Carden et al. | |

(Continued)

FOREIGN PATENT DOCUMENTS

KR 10-0564412 B1 * 3/2006 ..... F25D 23/02

*Primary Examiner* — Janet M. Wilkens
*Assistant Examiner* — Andrew Roersma
(74) *Attorney, Agent, or Firm* — Dority & Manning, P.A.

(57) ABSTRACT

An appliance is provided. The appliance includes a cabinet that defines a chamber. A container is received within the chamber. A biasing member is configured for urging the container upwardly along a vertical direction. By urging the container upwardly, the biasing member can lift the container and facilitate access to the container.

17 Claims, 9 Drawing Sheets

(56) References Cited

U.S. PATENT DOCUMENTS

| | | | | |
|---|---|---|---|---|
| 7,659,881 | B2 * | 2/2010 | Lee | 345/110 |
| 7,810,891 | B2 | 10/2010 | Lee et al. | |
| 2004/0104649 | A1 * | 6/2004 | Muller et al. | 312/333 |
| 2006/0021373 | A1 * | 2/2006 | Oh et al. | 62/407 |
| 2006/0022564 | A1 * | 2/2006 | Oh et al. | 312/402 |
| 2009/0193836 | A1 | 8/2009 | Ertz et al. | |
| 2010/0307187 | A1 * | 12/2010 | Kwon et al. | 62/407 |

* cited by examiner

APPLIANCE WITH FEATURES FOR FACILITATING ACCESS TO A CONTAINER

PRIORITY CLAIM

This application is a continuing application of and claims priority to U.S. patent application Ser. No. 13/552,991 filed on Jul. 19, 2012, which is incorporated herein by reference for all purposes.

FIELD OF THE INVENTION

The present subject matter relates generally to appliances with containers mounted therein, e.g., refrigerator appliances such as bottom-mount refrigerator appliances.

BACKGROUND OF THE INVENTION

Generally, refrigerator appliances include a cabinet that defines a fresh food chamber for receipt of fresh food items and a freezer chamber for receipt of frozen food items. The fresh food chamber and freezer chamber can be positioned in various locations relative to one another depending upon the particular style of refrigerator appliance. For example, the freezer chamber can be mounted below the fresh food chamber in what is commonly referred to as a "bottom-mount" refrigerator appliance.

Bottom-mount refrigerator appliances can include a freezer drawer that is slidably received within the freezer chamber. In addition, a container, such as a bin or basket, can be mounted or positioned on the freezer drawer such that the container shifts into and out of the freezer chamber as the freezer drawer slides open and closed. With the freezer drawer opened and the container positioned outside of the freezer chamber, a user can access the container to load or unload food items from the container. However, because the freezer chamber is positioned below the fresh food chamber at a bottom of the refrigerator appliance, a user generally has to bend or stoop to reach down into the container and access the food items stored therein. Such bending or stooping can be uncomfortable or undesirable and negatively affect a user's impression or use of the refrigerator appliance.

Accordingly, a refrigerator appliance with features for facilitating access to a container of the refrigerator appliance would be useful. In particular, a refrigerator appliance with features for lifting a container of the refrigerator appliance upwardly to facilitate access to the container would be useful.

BRIEF DESCRIPTION OF THE INVENTION

The present subject matter provides an appliance. The appliance includes a cabinet that defines a chamber. A container is received within the chamber. A biasing member is configured for urging the container upwardly along a vertical direction. By urging the container upwardly, the biasing member can lift the container and facilitate access to the container. Additional aspects and advantages of the invention will be set forth in part in the following description, or may be apparent from the description, or may be learned through practice of the invention.

In a first exemplary embodiment, an appliance is provided. The appliance defines vertical, lateral, and transverse directions. The vertical, lateral, and transverse directions are mutually perpendicular. The appliance includes a cabinet that defines a chamber. At least one transverse guide is supported by the cabinet. A drawer assembly is supported by the at least one transverse guide and configured for movement along the transverse direction in and out of the chamber of the cabinet on the at least one transverse guide. The drawer assembly includes at least one vertical guide. At least one track member is carried by the at least one vertical guide and is configured for movement along the vertical direction on the at least one vertical guide. The at least one track member defines a channel positioned within a vertical plane. A container is supported by the at least one track member. A biasing member is configured for urging the container and the at least one track member upwardly along the vertical direction. The biasing member has a guided end. The guided end of the biasing member is slidably received within the channel of the at least one track member.

In a second exemplary embodiment, an appliance is provided. The appliance defines vertical, lateral, and transverse directions. The vertical, lateral, and transverse directions are mutually perpendicular. The appliance includes a cabinet that defines a chamber. At least one transverse guide is supported by the cabinet. A drawer assembly is supported by the at least one transverse guide and configured for movement along the transverse direction in and out of the chamber of the cabinet on the at least one transverse guide. The drawer assembly includes at least one vertical guide. A container is carried by the at least one vertical guide and is configured for movement along the vertical direction on the at least one vertical guide. The container defines a channel positioned within a vertical plane. A biasing member is configured for urging the container upwardly along the vertical direction. The biasing member has a guided end that is slidably received into the channel of the container.

In a third exemplary embodiment, a refrigerator appliance is provided. The refrigerator appliance defines vertical, lateral, and transverse directions. The vertical, lateral, and transverse directions are mutually perpendicular. The refrigerator appliance includes a cabinet that defines a chilled chamber for receipt of food items for storage. At least one transverse guide is supported by the cabinet. A drawer assembly is supported by the at least one transverse guide and configured for movement along the transverse direction in and out of the chilled chamber of the cabinet on the at least one transverse guide. The drawer assembly includes at least one vertical guide. At least one track member is carried by the at least one vertical guide and is configured for movement along the vertical direction on the at least one vertical guide. A container is supported by the at least one track member. A biasing member is configured for urging the container and the at least one track member upwardly along the vertical direction. The biasing member has a guided end. The guided end of the biasing member is configured for sliding between a lifting configuration and a lowering configuration. The biasing member exerts sufficient force to lift the container upwardly along the vertical direction when the biasing member is in the lifting configuration. The biasing member exerts insufficient force to lift the container upwardly along the vertical direction when the biasing member is in the lowering configuration.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

In FIG. 2, an exemplary freezer drawer is shown in a closed position such that the freezer drawer is disposed within a freezer chamber of the refrigerator appliance. Also, an exemplary track member of the freezer drawer is shown in a retracted position, and a guide of an exemplary biasing member is shown in an upper position within a channel defined by the track member.

In FIG. 3, the freezer drawer is shown in an open position such that the freezer drawer is disposed outside of the freezer chamber. The track member of the freezer drawer is shown in the retracted position, and the guide of the biasing member is shown in the upper position within the channel.

In FIG. 4, the track member of the freezer drawer is shown in an extended position, and the guide of the biasing member is shown in the upper position within the channel.

In FIG. 5, the track member of the freezer drawer is shown in the extended position, and the guide of the biasing member is shown in a lower position within the channel defined by the track member.

In FIG. 6, the track member of the freezer drawer is shown in the retracted position, and the guide of the biasing member is shown in the lower position within the channel.

In FIG. 7, the track member of the freezer drawer is shown in the retracted position, and the guide of the biasing member is shown being adjusted from the lower position to the upper position by an exemplary resetting member.

DETAILED DESCRIPTION

Figure 1:
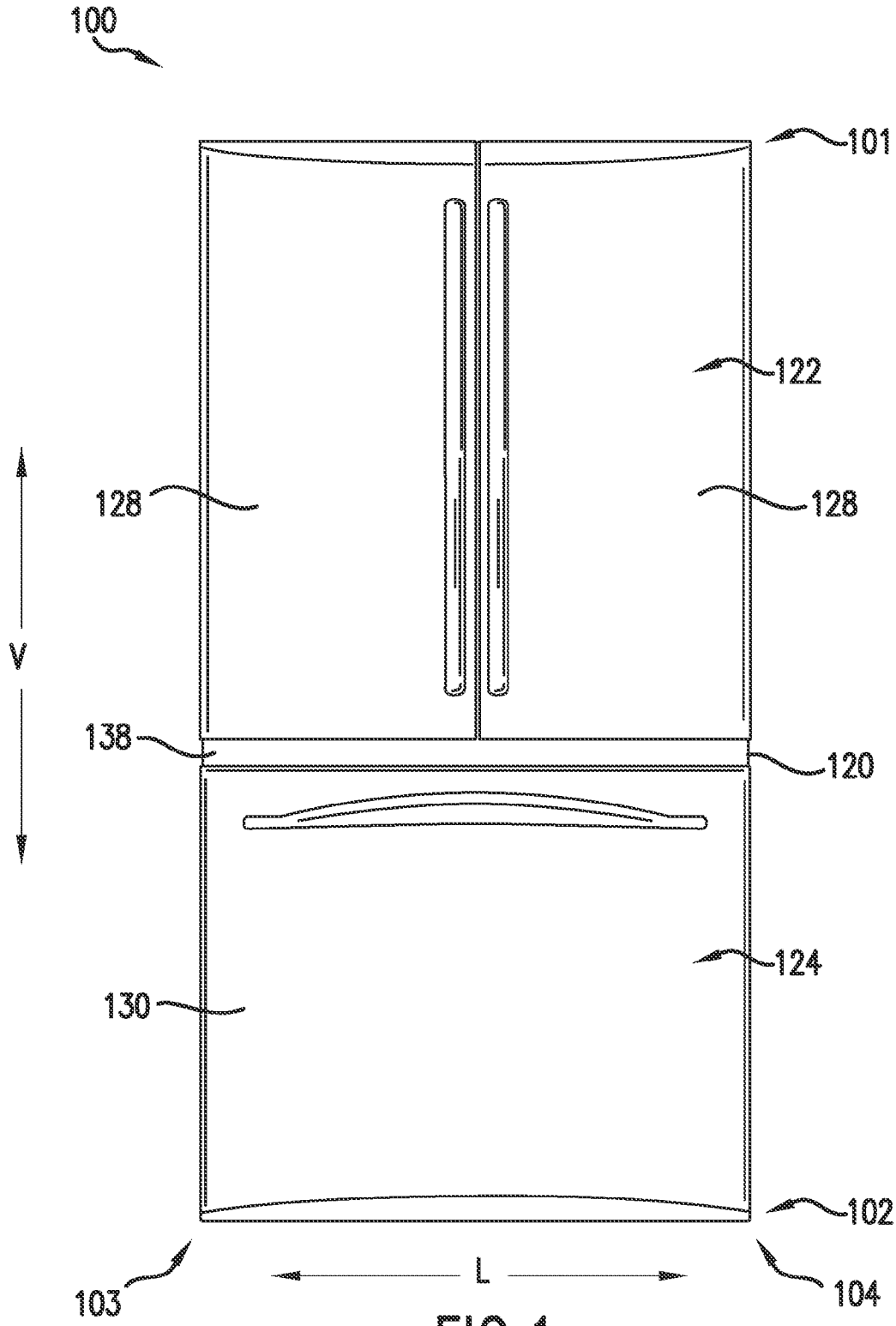
FIG. 1 provides a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front view of a refrigerator appliance 100 according to an exemplary embodiment of the present subject matter. As may be seen in FIG. 1, refrigerator appliance 100 includes a cabinet or housing 120. Housing 120 defines a vertical direction V, a lateral direction L, and a transverse direction T.

Figure 2:
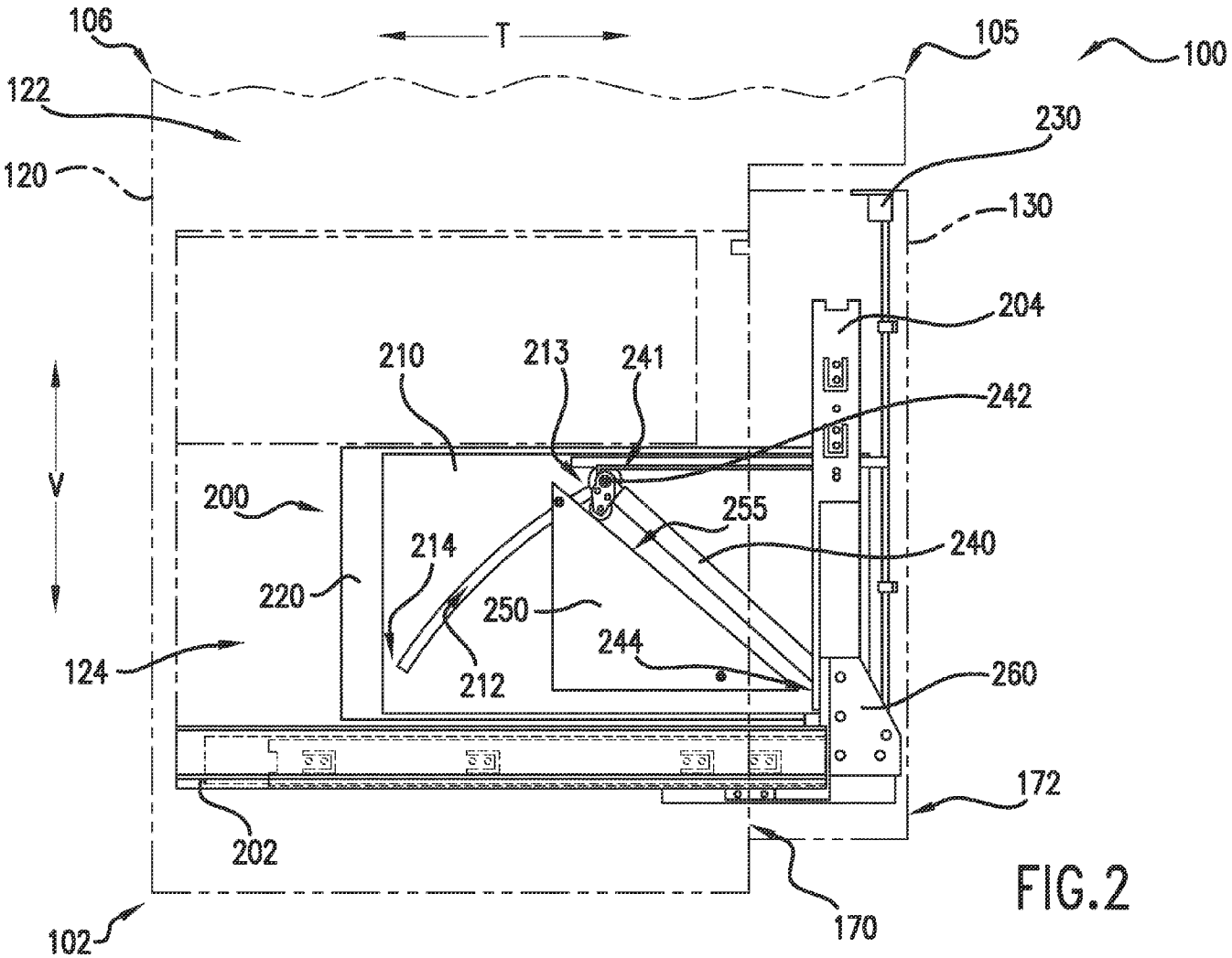
FIG. 2 is a side, partial cross-sectional view of the refrigerator appliance of FIG. 1.

Housing 120 extends between a top 101 and a bottom 102 along the vertical direction V. Housing 120 also extends between a first side 103 and a second side 104 along the lateral direction L. Housing 120 further extends between a front 105 (FIG. 2) and a back 106 (FIG. 2) along the transverse direction T (FIG. 2). The vertical direction V, lateral direction L, and transverse direction T are mutually perpendicular and form an orthogonal directional system.

Housing 120 defines chilled chambers for receipt of food items for storage. In particular, housing 120 defines fresh food chamber 122 positioned at or adjacent top 101 of housing 120 and a freezer chamber 124 arranged at or adjacent bottom 102 of housing 120. As such, the refrigerator 100 is generally referred to as a bottom mount refrigerator. It is recognized, however, that the benefits of the present disclosure apply to other types and styles of refrigerators such as, for example, a top mount refrigerator or a side-by-side style refrigerator. Consequently, the description set forth herein is for illustrative purposes only and is not intended to be limiting in any aspect to a particular chilled chamber configuration. Similarly, it is recognized that the benefits of the present disclosure apply to other types of appliances as well, e.g., range appliance, dishwasher appliances, or freezer appliances.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a drawer assembly or freezer drawer 200 (FIG. 3) slidably mounted within freezer chamber 124. Refrigerator doors 128 and freezer door 130 are shown in a closed position in FIG. 1. In the closed position, refrigerator doors 128 and freezer door 130 hinder access to fresh food chamber 122 and freezer chamber 124 respectively.

FIGS. 2-7 illustrate partial cross-sectional views of refrigerator appliance 100. In particular, FIGS. 2-7 illustrate freezer drawer 200 opening and closing in order to permit a support or track member 210 of freezer drawer 200 to raise and lower. As discussed in greater detail below, by raising and lowering, track member 210 can facilitate or assist user access to a container 220 mounted to or positioned on track member 210.

As may be seen in FIGS. 2-7, freezer drawer 200 is mounted within freezer chamber 124 of housing 120. In particular, freezer drawer 200 is slidably mounted within freezer chamber 124 with at least one transverse guide 202. In FIG. 2, transverse guide 202 is shown as a drawer slide assembly. However, in alternative embodiments, transverse guide 202 may be any other suitable mechanism for mounting freezer drawer 200 for movement into and out of freezer chamber 124.

Figure 3:
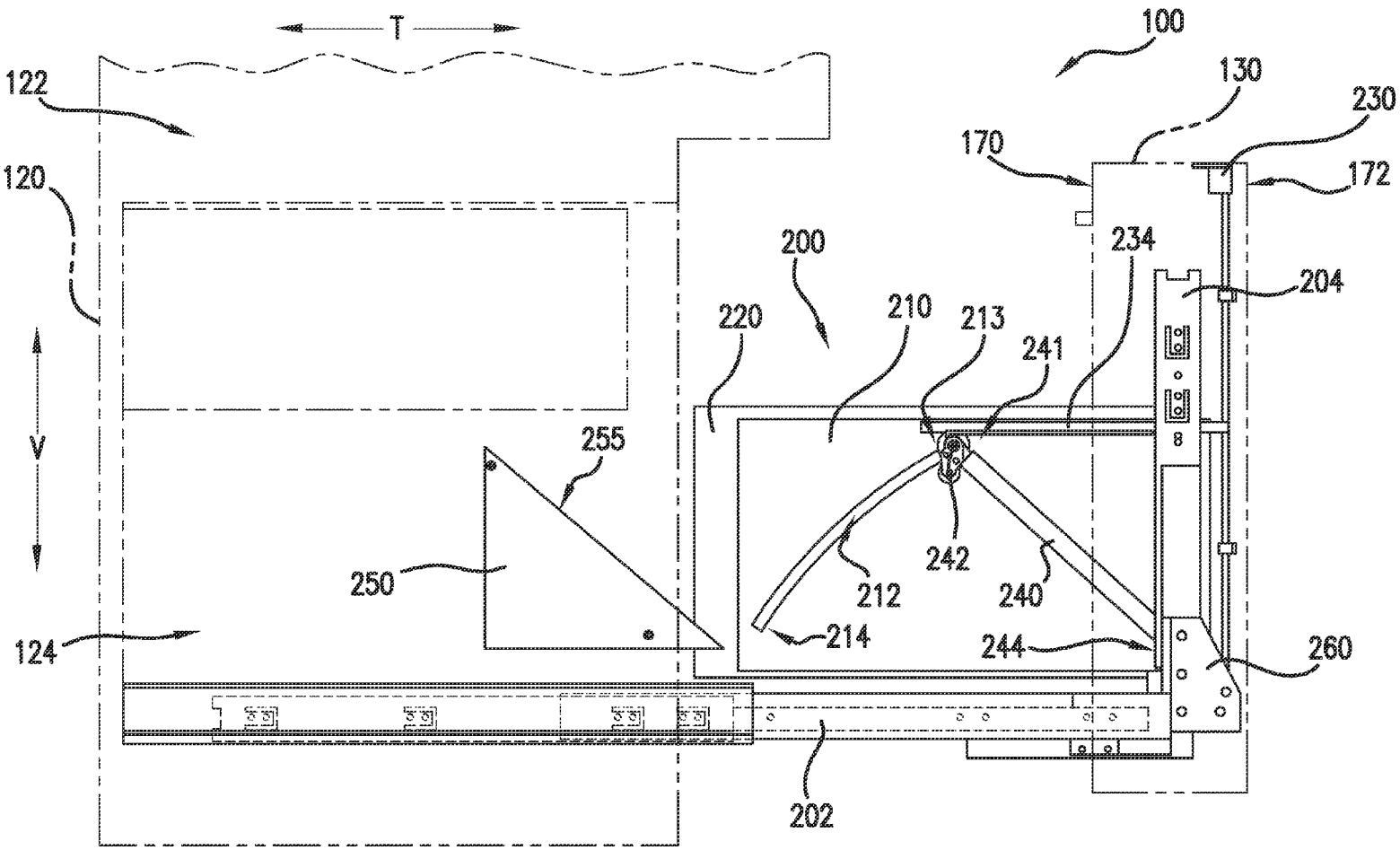
FIG. 3 is a side, partial cross-sectional view of the refrigerator appliance of FIG. 1.

Freezer drawer 200 may be selectively shifted on transverse guide 202 between a closed position (shown in FIG. 2) and an open position (shown in FIG. 3). Freezer drawer 200 is disposed within freezer chamber 124 in the closed position. Conversely, freezer drawer 200 is partially or fully disposed outside of freezer chamber 124 in the open position. A user can selectively adjust freezer drawer 200 between the open and closed positions. For example, when freezer drawer 200 is in the closed position as shown in FIG. 2, the user can pull on freezer door 130 in the transverse direction T away from cabinet 120 in order to slide freezer drawer 200 out of freezer chamber 124 to the open position shown in FIG. 3.

Freezer door 130 is mounted to freezer drawer 200. When freezer drawer 200 is in the closed position, freezer door 130 impedes access to freezer chamber 124. Conversely, when freezer drawer 200 is in the open position, freezer door 130 permits access to freezer chamber 124. Thus, freezer drawer 200 is also configured for selectively adjusting the position of freezer door 130 in order to permit selective access to freezer chamber 124.

Freezer door 130 has an interior surface 170 spaced apart from an exterior surface 172 along the transverse direction T. A cavity (not shown) is defined between interior and exterior surface 170, 172. The cavity is filled within insulation, e.g., in order to assist in limiting heat transfer between freezer chamber 124 and an exterior atmosphere when freezer drawer 200 is in the closed position and freezer door 130 seals freezer chamber 124.

Container (e.g., a basket or bin) 220 is disposed on freezer drawer 200 and configured for receipt of food items. Such food items can be placed within a storage volume (not shown) defined by container 220. Container 220 is removably positioned or mounted on freezer drawer 200. Thus, a user can lift container 220 off freezer drawer 200, e.g., in order to clean container 220.

In the exemplary embodiment shown in FIG. 2, container 220 is selectively supported by track member 210 of freezer drawer 200 (i.e., container 220 is removable). However, in alternative exemplary embodiments, container 220 may be integrally mounted to track member 210 of freezer drawer 200 such that the components form a single element and container 220 is not removable. In additional alternative exemplary embodiments, container 220 can be fixed or coupled to freezer drawer 200 with fasteners, snap-fit mechanisms, interference fit mechanisms, or any other suitable connector. Also, in FIG. 2, a single container 220 is mounted to freezer drawer 200. However, freezer drawer 200 may support any suitable number of containers, e.g., two, three, or more.

Track member 210 of freezer drawer 200 and container 220 are mounted or supported for movement along the vertical direction V. In particular, at least one vertical guide 204 mounted to freezer door 130 supports track member 210 and container 220 for movement along the vertical direction V. Thus, track member 210 and container 220 may shift on vertical guide 204 along the vertical direction V between a retracted position (shown in FIG. 3) and an extended position (shown in FIG. 4). In FIG. 2, vertical guide 204 is shown as drawer slide assembly. However, in alternative embodiments, vertical guide 204 may be any other suitable mechanism for mounting track member 210 and container 220 for movement along the vertical direction V.

At least one biasing member 240 urges track member 210 and container 220 upwardly along the vertical direction V. In FIGS. 2-7, biasing member 240 is shown as gas strut. However, biasing member 240 may be any other suitable mechanism for urging track member 210 and container 220 upwardly along the vertical direction V between the retracted position and extended position, e.g., a spring, a linear actuator, a solenoid, or a combination thereof. Biasing member 240 extends between a fixed end 244 rotatably mounted to framing 260 and a guided end 241. Guided end 241 of biasing member 240 includes a guide 242 (e.g., a roller, boss, or wheel). Guide 242 of guided end 241 is configured for receipt within a channel 212 defined within a vertical plane on track member 210 or container 220. In alternative exemplary embodiments, channel 212 may defined by other components of refrigerator appliance 100 (e.g., freezer drawer 200) with fixed end 244 shifted accordingly (e.g., to track member 210 or container 220).

Channel 212 extends between a first or top portion 213 and a second or bottom portion 214. Top portion 213 of channel 212 is spaced apart from bottom portion 214 of channel 212 along the vertical direction V. Thus, channel 212 extends along the vertical direction V. Channel 212 also extends along the transverse direction T because top portion 213 of channel 212 is spaced apart from bottom portion 214 of channel 212 along the transverse direction T. In FIG. 2, channel 212 has an arcuate shape. However, channel 212 may have any suitable shape. For example, channel 212 may have a parabolic shape, a curvilinear shape, a linear shape, or a combination thereof. Thus, as will be understood by those skilled in the art, channel 212 shown in FIGS. 2-7 is provided by way of example only and is not intended to limit the present subject matter in any manner.

Figure 4:
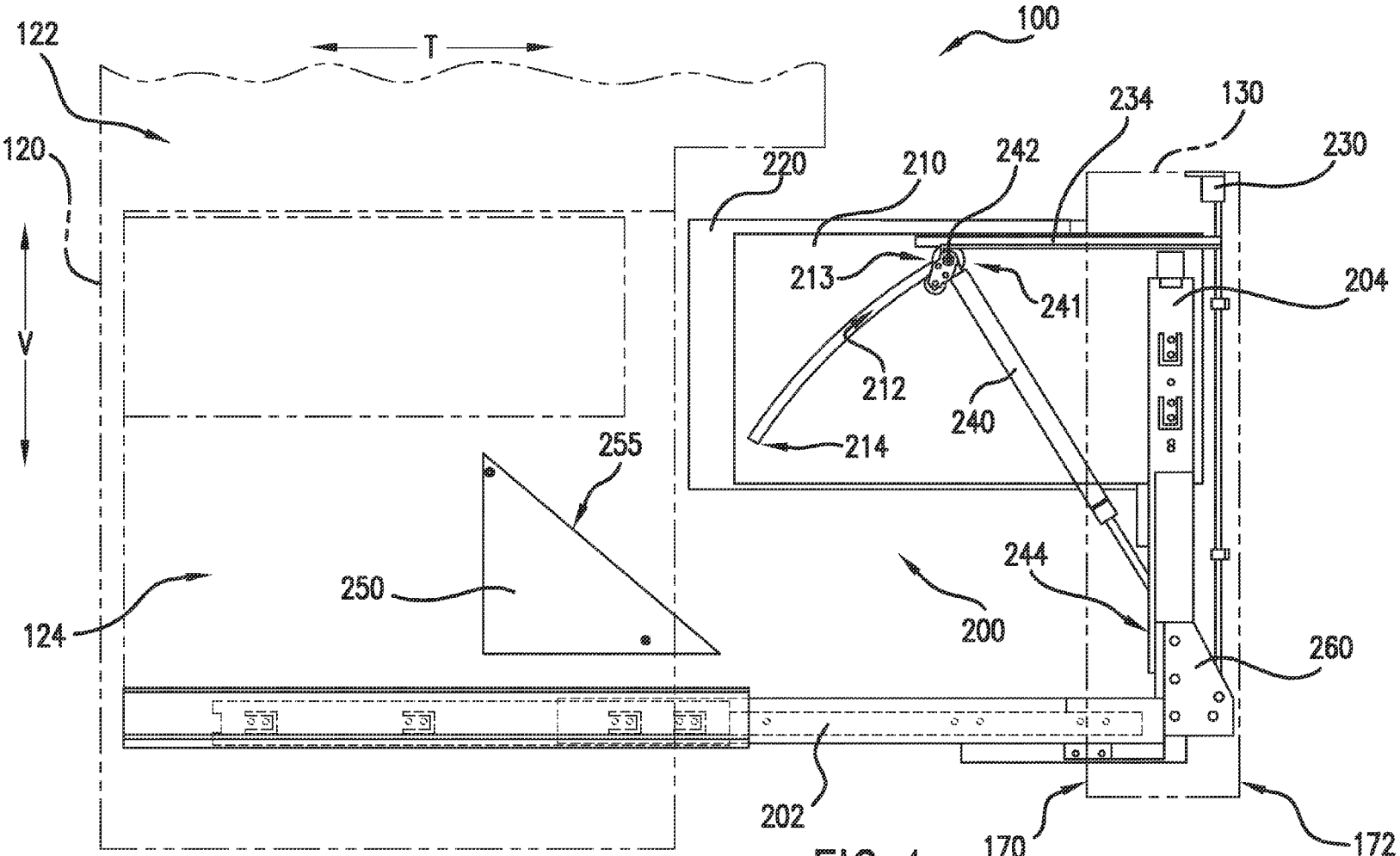
FIG. 4 is a side, partial cross-sectional view of the refrigerator appliance of FIG. 1.

In the exemplary embodiment shown in FIGS. 2-7, a center of rotation (e.g., fixed end 244) of biasing member 240 is concentrically positioned relative to arcuate channel 212. Thus, biasing member 240 has may extend longitudinally by about the radius of the arcuate channel 212 when track member 210 and container 220 are in the extended position as shown in FIG. 4. However, in alternative exemplary embodiments, center of rotation of biasing member 240 may be non-concentrically or eccentrically positioned relative to arcuate channel 212.

Guide 242 of biasing member 240 slides within channel 212. In particular, guide 242 shifts between an upper position (shown in FIG. 4) and a lower position (shown in FIG. 5) by sliding within channel 212. With guide 242 in the upper position, biasing member 240 is positioned at or adjacent top portion 213 of channel 212 and exerts sufficient force (e.g., along the vertical direction V) to lift track member 210 and container 220 upwardly along the vertical direction V from the retracted portion to the extend position. Conversely, with guide 242 in the lower position, biasing member 240 is positioned at or adjacent bottom portion 214 of channel 212 and exerts insufficient force (e.g., along the vertical direction V) to lift track member 210 and container 220 upwardly along the vertical direction V from the retracted portion to the extend position. Further, track member 210 and container 220 shift downwardly along the vertical direction V from the extended portion to the retracted position when guide 242 of biasing member 240 is in the lower position.

Figure 5:
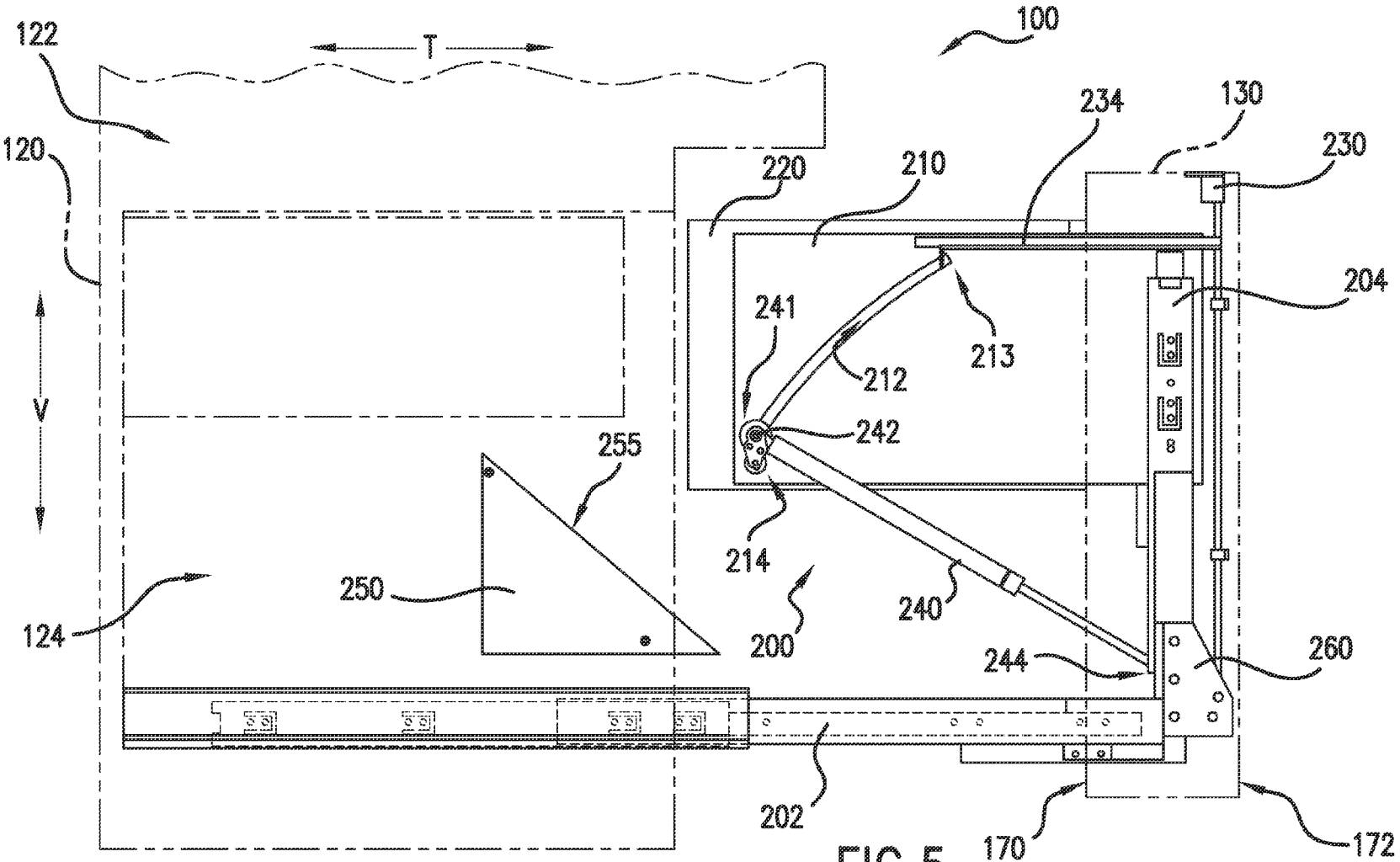
FIG. 5 is a side, partial cross-sectional view of the refrigerator appliance of FIG. 1.
Figure 6:
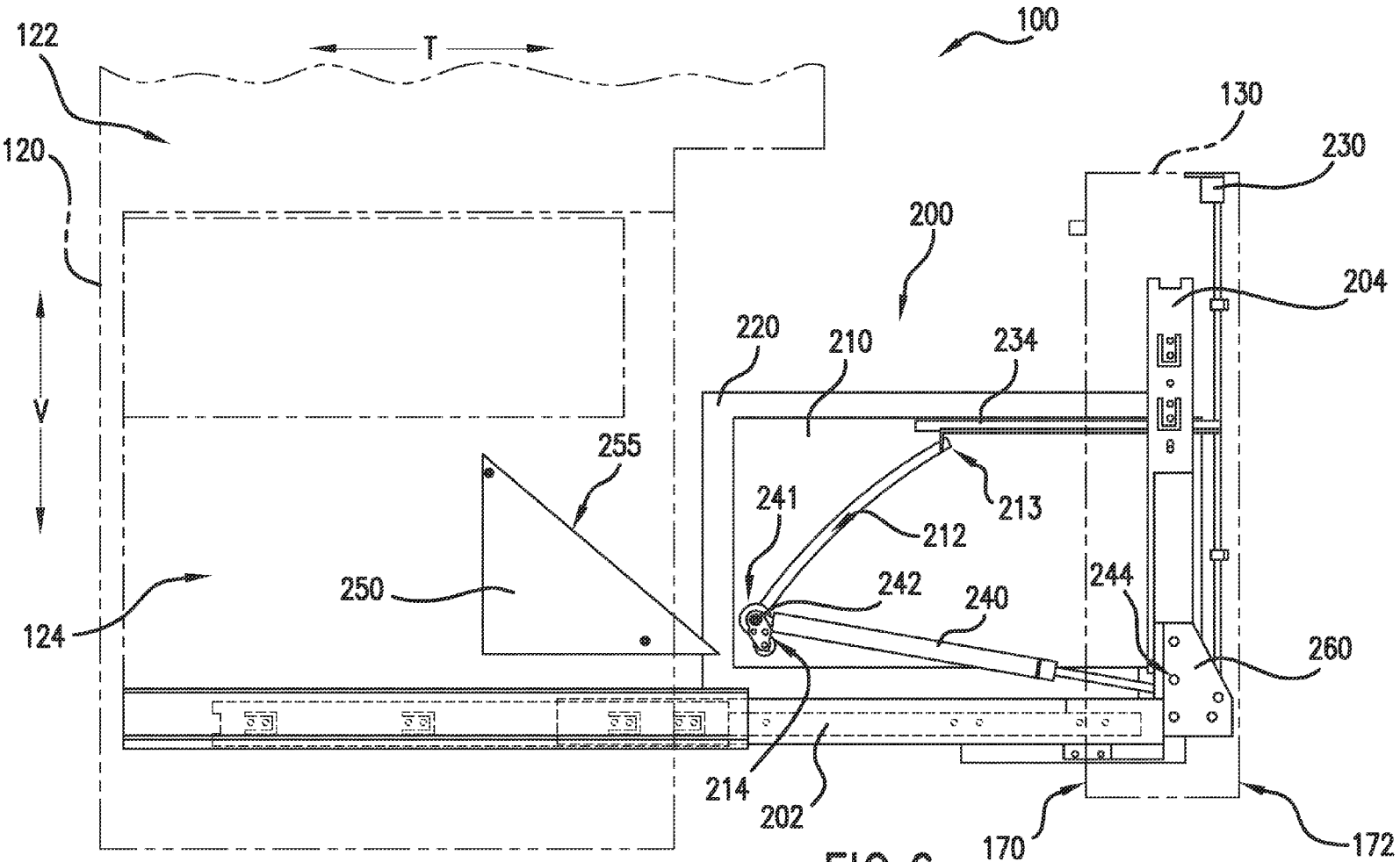
FIG. 6 is a side, partial cross-sectional view of the refrigerator appliance of FIG. 1.
Figure 9:
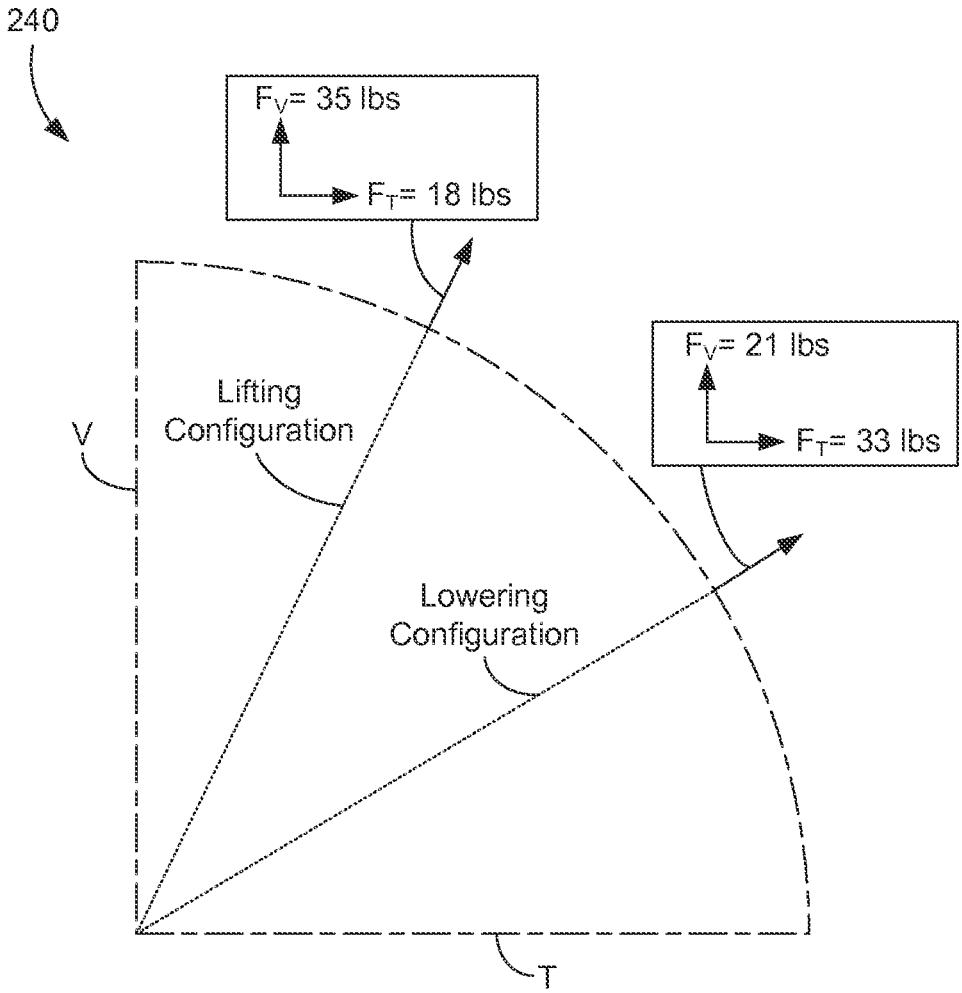
FIG. 9 is a schematic view of the biasing member with the force components exerted by the biasing member along a vertical and a transverse direction shown for both the lifting configuration and the lowering configuration.

Turning to FIG. 9, biasing member 240 is discussed in greater detail. FIG. 9 is a schematic view of biasing member 240 with force components exerted by biasing member 240 along the vertical direction V and the transverse direction T shown for both a lifting configuration (i.e., with guide 242 in the upper position within channel 212 as shown in FIG. 4) and a lowering configuration (i.e., with guide 242 in the lower position within channel 212 as shown in FIG. 5). In FIG. 9, biasing member 240 exerts thirty-nine pounds of total force. As may be seen in FIG. 9, in the lifting configuration, biasing member 240 exerts about thirty-five pounds of force along the vertical direction V and about eighteen pounds of force along the transverse direction T. Conversely, in the lowering configuration, biasing member 240 exerts about twenty-one pounds of force along the vertical direction V and about thirty-three pounds of force along the transverse direction T. Thus, biasing member 240 exerts about fourteen pounds of force less along the vertical direction V in the lowering configuration relative to the lifting configuration. Such force differential permits selective raising and lowering of track member 210 and container 220 along vertical direction V by biasing member 240 as described in greater detail below.

As an aside, the values provided in FIG. 9 are provided by way of example only. Thus, biasing member 240 may exert more or less total force. Similarly, distribution of the total force may vary between exemplary embodiments of the present subject matter. Thus, in alternative exemplary embodiments, substantially all of the total force exerted by biasing member 240 may be exerted along the vertical direction V when guide 242 of biasing member 240 is in the upper position, or substantially all of the total force exerted by biasing member 240 may be exerted along the transverse direction T when guide 242 of biasing member 240 is in the lower position. Other suitable configurations are available as well, e.g., based upon the shape and orientation of channel 212.

Turning back to FIGS. 2-7, refrigerator appliance 100 further includes a resetting member 250 disposed within freezer chamber 124. Resetting member 250 has a sloped surface 255 for engaging guide 242 of biasing member 240. As discussed in greater detail below, resetting member 250 assists with shifting guide 242 of biasing member 240 from the lower position to the upper position.

Refrigerator appliance 100 also includes a latching mechanism 230. Latch mechanism 230 is configured for selectively securing track member 210 (and container 220) in the retracted position. Further, latch mechanism 230 is configured for selectively securing track member 210 (and container 220) in the extended position. Latch mechanism 230 is shown in greater detail in FIG. 8.

Figure 8:
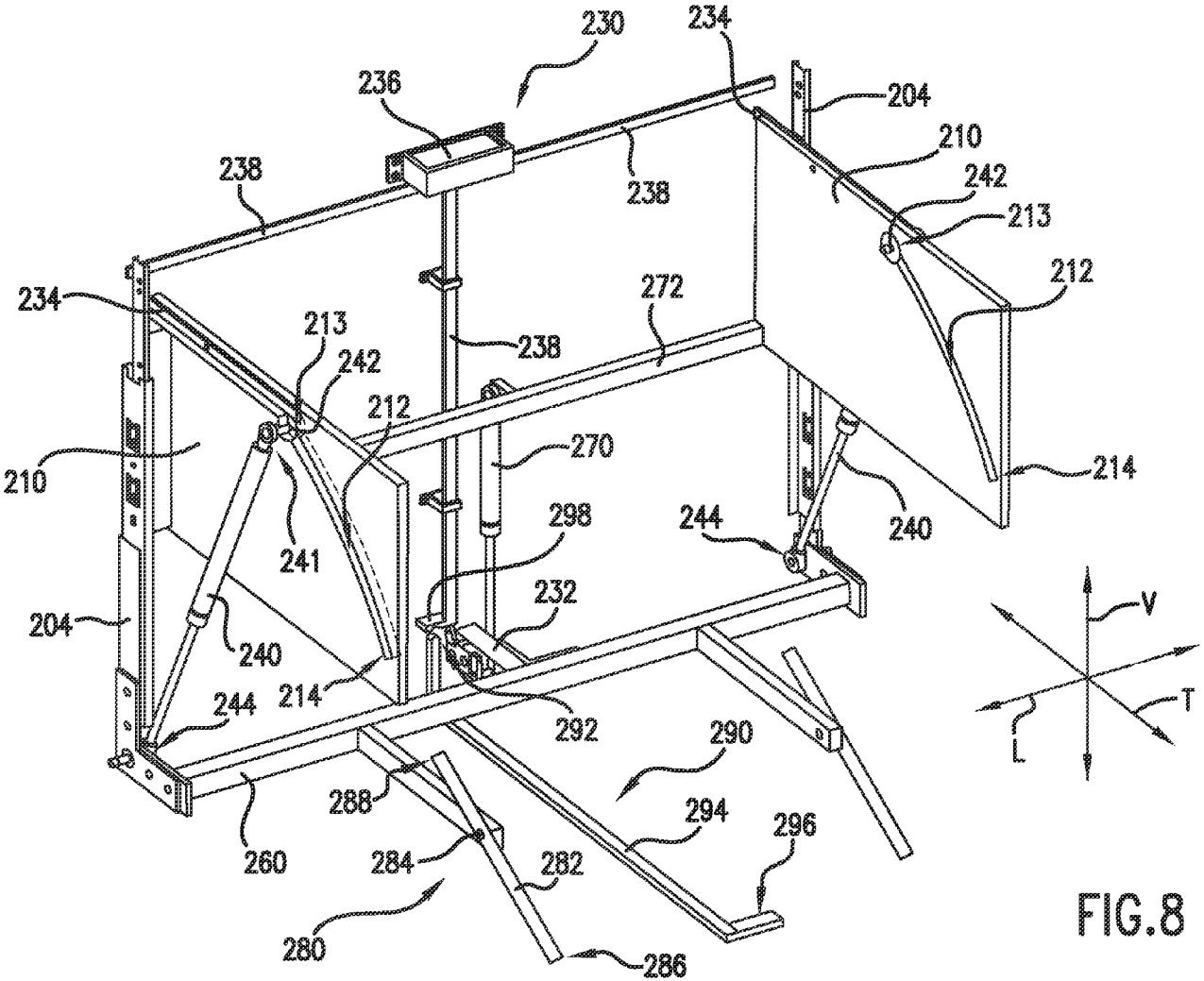
FIG. 8 is a perspective view of an exemplary latch mechanism of the refrigerator appliance of FIG. 1 removed from the refrigerator appliance.

FIG. 8 is a perspective view of latch mechanism 230 removed from refrigerator appliance 100. Latch mechanism 230 includes a bottom latch 232 and top latches 234. An actuator 236 (e.g., a button or knob) is in communication with bottom latch 232 and top latches 234 via transfer members 238. Thus, transfer members 238 extend between and connect actuator 236 with bottom latch 232 and top latches 234. Transfer member 238 connecting bottom latch 232 and actuator 236 may be orthogonally oriented relative to transfer members 238 connecting top latches 234 and actuator 236, e.g., to insure simultaneous activation of both top latches 234. Further, transfer linkages 238 may only actuate top latches 234 when track member 210 and container 220 are in the extended position, e.g., to prevent unintended sliding of guide 242 of biasing member 240 from the upper position to the lower position.

Bottom latch 232 can engage track member 210 or container 220 to secure track member 210 and container 220 in the retracted position despite biasing member 240 urging track member 210 and container 220 upwardly along the vertical direction V. Top latches 234 can engage guide 242 of biasing member 240 to secure guide 242 in the upper position within channel 212 as shown in FIG. 8. A user can utilize actuator 236 to cause bottom latch 232 to release track member 210 and container 220 from the retracted positions or to cause top latches 234 to release guide 242 of biasing member 240 from the upper position. For example, when the user operates actuator 236 to cause top latches 234 to release guide 242 from the upper position, guide 242 can shift or slide within channel 212 to the lower position, e.g., due to gravity urging guide 242 downwardly or expansion of biasing member 240 may shift guide 242 downwardly within channel 212.

As may be seen in FIGS. 2 and 8, framing 260 extends between and connects transverse guides 202 and vertical guides 204. Further, fixed end 244 of biasing member 240 is rotatably mounted to framing 260. However, in alternative exemplary embodiments, fixed end 244 of biasing member 240 may be rotatably mounted at other locations within refrigerator appliance, e.g., to freezer door 130, to vertical guides 204, or to transverse guides 202.

A closing lockout 280 is mounted to framing 260. Closing lockout 280 includes a bar 282 that is rotatably mounted to framing 260 such that bar 282 rotates about a pivot 284. Bar 282 extends between a first end 286 and a second end 288. Bar 282 rotates about pivot 284 such that first end 286 of bar 282 selectively engages cabinet 120 (FIG. 2) depending upon the position of container 220 (FIG. 2) in order to prevent freezer drawer 200 (FIG. 2) from closing when container 220 is in the extended position (shown in FIG. 4).

As an example, when container 220 is in the extended position, first end 286 of bar 282 drops downwardly along the vertical direction V. When first end 286 of bar 282 drops downwardly, first end 286 of bar 232 engages cabinet 120 when a user attempts to push freezer drawer 200 closed in order to prevent or hinder freezer drawer 200 from closing. Conversely, when container 220 is in the retracted position, container 220 rests on second end 288 of bar 282 such that first end 286 of bar 282 is lifted upwardly. When first end 286 of bar 282 is lifted upwardly, first end 286 of bar 282 does not engage cabinet 120 when the user attempts to push freezer drawer 200 closed and thus freezer drawer 200 can close freely.

A lifting lockout 290 is also mounted to framing 260. Lifting lockout 290 includes a block 292 and a hook 296 that are connected with a shaft 294. Block 292 is configured for selectively engaging a linkage tip 298 of latch mechanism 230 depending upon the position of freezer drawer 200 (FIG. 2) in order to prevent or hinder bottom latch 232 from releasing container 220 from the retracted position (FIG. 3) when freezer drawer 200 is not in the open position (FIG. 3).

As an example, when freezer drawer 200 is in the closed position (FIG. 2), block 292 is disposed directly beneath linkage tip 298 along the vertical direction V. Thus, when a user attempts to push actuator 236 and cause bottom latch 232 to release container 220, block 292 prevents downward motion of transfer member 238 and thus prevents actuator 236 from operating bottom latch 232. Conversely, when freezer drawer 200 is shifted to the open position (FIG. 3), hook 296 engages a portion of cabinet 112 and pulls block 292 out from beneath linkage tip 298. Thus, when the user pushes actuator 236, block 292 does not prevent downward motion of transfer member 238 and actuator 236 operates bottom latch 232 to release container 220.

A damper 270 is mounted to framing 260. In particular, damper 270 extends between framing 260 and a cross-bar 272 that connects track members 210. Damper 270 is configured for hindering or preventing track members 210 and/or container 220 from dropping roughly or forcefully from the extended position to the retracted position. In other words, track member 210 and container 220 drop gently or in a controlled manner due to damper 270. In FIG. 8, damper 270 is shown as a gas strut. However, damper 270 may be any other suitable mechanism in alternative exemplary embodiments, e.g., a spring or dashpot.

As discussed above, FIGS. 2-7 illustrate freezer drawer 200 opening and closing in order to permit track member 210 of freezer drawer 200 to raise and lower. In particular, freezer drawer 200 is shown in the closed position in FIG. 2 such that freezer drawer 200 is disposed within freezer chamber 124 of refrigerator appliance 100. Also, track member 210 of freezer drawer 200 is shown in the retracted position, and guide 242 of biasing member 240 is shown in the upper position. The configuration of freezer drawer 200, track member 210, and biasing member 240 shown in FIG. 2 can be utilized to store food items within container 220 in freezer chamber 124 because freezer door 130 seals freezer chamber 124. However, from the configuration shown in FIG. 2, a user may desire to access food items within container 220 or add food items to container 220. Refrigerator appliance 100 includes features for assisting the user with accessing container 220 as described in greater detail below.

As an example, from the closed position shown in FIG. 2, a user can pull on freezer door 130 to shift freezer drawer 200 on transverse guide 202 in the transverse direction T to the open position shown in FIG. 3. With freezer drawer 200 in the open position as shown in FIG. 3, track member 210 and container 220 are disposed outside of freezer chamber 124 and are free to move upwardly along the vertical direction V on vertical guide 204. At this point, the user can utilize actuator 236 (FIG. 8) to cause bottom latch 232 (FIG. 8) to release track member 210 and container 220. When bottom latch 232 releases track member 210 and container 220, biasing member 240 urges track member 210 and container 220 upwardly along the vertical direction V from the retracted position shown in FIG. 3 to the extended position shown in FIG. 4. Biasing member 240 lifts track member 210 and container 220 upwardly because guide 242 of biasing member 240 is in the upper position within channel 212 and a sufficient portion of the total force exerted by biasing member 240 is directed along the vertical direction V to lift track member 210 and container 220. In alternative exemplary embodiments, biasing member 240 could simply assist the user with lifting track member 210 and container 220 upwardly along the vertical direction V rather than solely lifting track member 210 and container 220, e.g., when container 220 is heavily loaded.

With container 220 lifted to the extended position as shown in FIG. 4, the user can more easily access the storage volume (not shown) of container 220. For example, the user does not have to bend or stoop over to access the container 220. Thus, e.g., heavier food articles may be more easily added or removed from container 220.

After the user has finished loading and/or removing food articles from container 220, the user can utilize actuator 236 to cause top latches 234 to release guide 242 of biasing member 240 and permit guide 242 of biasing member 240 to shift within channel 212 from the upper position shown in FIG. 4 to the lower position shown in FIG. 5. With guide 242 of biasing member 240 in the lower configuration, track member 210 and container 220 shift downwardly from the extended position shown in FIG. 5 to the retracted position shown in FIG. 6. Track member 210 and container 220 shift downwardly because when guide 242 of biasing member 240 is in the lower position within channel 212 an insufficient portion of the total force exerted by biasing member 240 is directed along the vertical direction V to maintain track member 210 and container 220 in the extended position. However, sufficient force can be exerted by biasing member 240 along the vertical direction V to prevent track member 210 and container 220 from dropping roughly or forcefully to the retracted position (i.e., track member 210 and container 220 drop gently in a controlled manner). In alternative exemplary embodiments, the user may be required to push downwardly on track member 210 and/or container 220 to shift track member 210 and container 220 downwardly along the vertical direction V, e.g., when container 220 is empty or lightly loaded.

Figure 7:
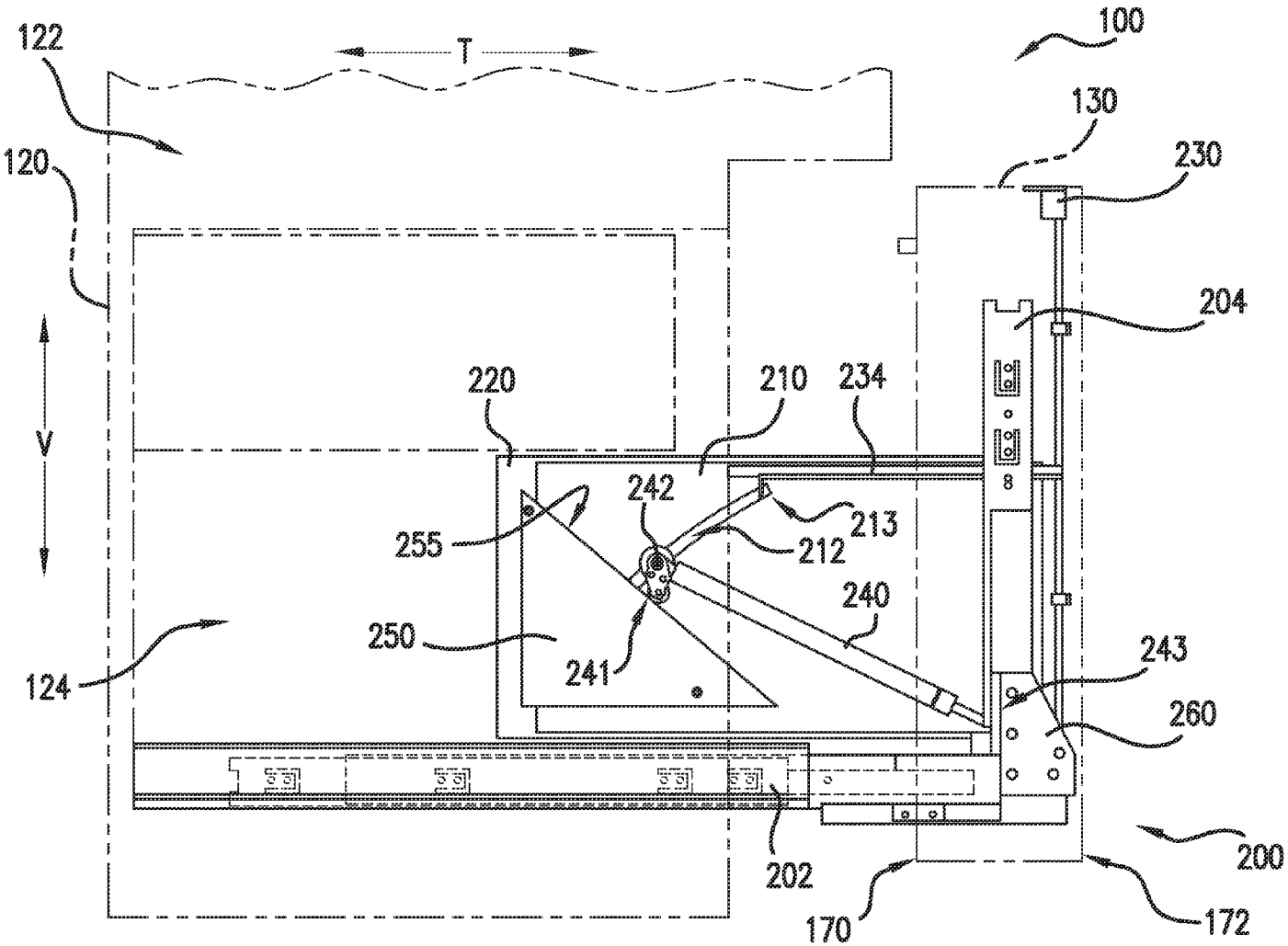
FIG. 7 is a side, partial cross-sectional view of the refrigerator appliance of FIG. 1.

When track member 210 and container 220 are disposed in the retracted position, bottom latch 232 can engage track member 210 and container 220 to lock track member 210 and container 220 in the retracted position. With track member 210 and container 220 in the retracted position, freezer drawer 200 may be shifted from the open position shown in FIG. 6 towards the closed position as shown in FIG. 2. As freezer drawer 200 shifts or slides towards the closed position, guide 242 of biasing member 240 engages resetting member 250 as shown in FIG. 7. In particular, guide 242 slides up sloped surface 255 of resetting member 250. As guide 242 slides up sloped surface 255, guide 242 of biasing member 240 shifts from the lower position back to the upper position. Thus, when freezer drawer 200 is completely shifted into the closed position freezer drawer 200, track member 210 and container 220, and biasing member 240 are positioned as shown in FIG. 2 and the above described process may be repeated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, the appliance defining vertical, lateral, and transverse directions, the vertical, lateral, and transverse directions being mutually perpendicular, the appliance comprising:

a cabinet defining a chamber;

at least one transverse guide supported by said cabinet;

a drawer assembly supported by said at least one transverse guide and configured for movement along the transverse direction in and out of the chamber of said cabinet on said at least one transverse guide, said drawer assembly comprising:

at least one vertical guide;

at least one track member carried by said at least one vertical guide and configured for movement along the vertical direction on said at least one vertical guide, said at least one track member defining a channel positioned within a vertical plane, the channel extending between a first end portion and a second end portion, the first end portion of the channel positioned above the second end portion of the channel along the vertical direction;

a container supported by said at least one track member;

a biasing member configured for urging said container and said at least one track member upwardly along the vertical direction, said biasing member having a guided end, the guided end of said biasing member slidably received within the channel of said at least one track member, the guided end of said biasing member positioned at the first end portion of the channel when said container is being raised, the guided end of said biasing member positioned at the second end portion of the channel when said container is being lowered;

a latch mechanism positioned at the first end portion of the channel, said latch mechanism configured for engaging and selectively securing the guided end of said biasing member at the first end portion of the channel; and a resetting member mounted within the chamber of said cabinet, said resetting member having a sloped surface for engaging the guided end of said biasing member.

2. The appliance of claim 1, wherein the channel of said at least one track member extends between a top segment and a bottom segment, the channel having an arcuate shape in the vertical plane between the top segment and the bottom segment.

3. The appliance of claim 1, wherein said drawer assembly further comprises:

a door mounted to said at least one transverse guide and configured for providing selective access to the chamber of said cabinet, said door extending between a top portion and a bottom portion along the vertical direction; and wherein said latch mechanism comprises a bottom latch positioned at the bottom portion of said door, said bottom latch selectively securing said at least one track member and said container in a retracted position.

4. The appliance of claim 3, wherein the channel of said at least one track member extends between a top segment and a bottom segment, wherein said latch mechanism further comprises an upper latch mounted at the top portion of said door and selectively securing the guided end of said biasing member when the guided end of said biasing member is positioned in the top segment of the channel.

5. The appliance of claim 1, further comprising:

a closing lockout having a bar rotatably mounted to said drawer assembly, the bar extending between a first end and a second end, the first end of the bar rotatable between a first position when said container is in a retracted position and a second position when said container is in an extended position, the first and second positions spaced apart along the vertical direction;

a door mounted to said at least one transverse guide and configured for providing selective access to the chamber of said cabinet, said door extending between a top portion and a bottom portion along the vertical direction; and wherein said latch mechanism comprises a bottom latch positioned at the bottom portion of said door, said bottom latch selectively securing said at least one track member and said container in a retracted position, said latch mechanism also having an actuator and a transfer member, the actuator configured for moving the transfer member in order to operate said bottom latch; and a lifting lockout having a block, the block positioned beneath the transfer member of said latch mechanism along the vertical direction when said drawer assembly is in a closed position in order to prevent operation of said bottom latch with the transfer member.

6. The appliance of claim 1, wherein said drawer assembly further comprises framing connecting said at least one transverse guide and said at least one vertical guide, wherein said biasing member extends between the guided end and a fixed end, the fixed end of said biasing member being rotatably mounted to the framing of said drawer assembly.

7. The appliance of claim 6, further comprising a cross-bar that extends from said at least one track member and a damper that extends between said framing and said cross-bar.

8. The appliance of claim 1, wherein said biasing member comprises at least one of a gas strut, a spring, a linear actuator, and a solenoid.

9. An appliance, the appliance defining vertical, lateral, and transverse directions, the vertical, lateral, and transverse directions being mutually perpendicular, the appliance comprising:

a cabinet defining a chamber;

at least one transverse guide supported by said cabinet;

a drawer assembly supported by said at least one transverse guide and configured for movement along the transverse direction in and out of the chamber of said cabinet on said at least one transverse guide, said drawer assembly comprising:

at least one vertical guide;

a container carried by said at least one vertical guide and configured for movement along the vertical direction on said at least one vertical guide, said container defining a channel positioned within a vertical plane, the channel extending between a first end portion and a second end portion, the first end portion of the channel positioned above the second end portion of the channel along the vertical direction;

a biasing member configured for urging said container upwardly along the vertical direction, said biasing member having a guided end that is slidably received into the channel of said container, the guided end of said biasing member positioned at the first end portion of the channel when said container is being raised, the guided end of said biasing member positioned at the second end portion of the channel when said container is being lowered;

a latch mechanism positioned at the first end portion of the channel, said latch mechanism configured for engaging and selectively securing the guided end of said biasing member at the first end portion of the channel; and a resetting member mounted within the chamber of said cabinet, said resetting member having a sloped surface for engaging the guided end of said biasing member.

10. The appliance of claim 9, wherein the channel of said container extends between a top segment and a bottom segment, the channel having an arcuate shape in the vertical plane between the top segment and the bottom segment.

11. The appliance of claim 9, further comprising:

a door mounted to said at least one transverse guide and configured for providing selective access to the chamber of said cabinet, said door extending between a top portion and a bottom portion along the vertical direction; and wherein said latch mechanism comprises a bottom latch positioned at the bottom portion of said door, said bottom latch selectively securing said at least one track member and said container in a retracted position.

12. The appliance of claim 11, wherein the channel of said container extends between a top segment and a bottom segment, wherein said latch mechanism further comprises an upper latch mounted at the top portion of said door and selectively securing the guided end of said biasing member when the guided end of said biasing member is positioned in the top segment of the channel.

13. The appliance of claim 9, wherein said drawer assembly further comprises framing connecting said at least one transverse guide and said at least one vertical guide, wherein said biasing member extends between the guided end and a fixed end, the fixed end of said biasing member being rotatably mounted to the framing of said drawer assembly.

14. The appliance of claim 13, further comprising a damper extending between said framing and said container.

15. The appliance of claim 9, wherein said biasing member comprises at least one of a gas strut, a spring, a linear actuator, and a solenoid.

16. A refrigerator appliance, the refrigerator appliance defining vertical, lateral, and transverse directions, the vertical, lateral, and transverse directions being mutually perpendicular, the refrigerator appliance comprising:

a cabinet defining a chilled chamber for receipt of food items for storage;

at least one transverse guide supported by said cabinet;

a drawer assembly supported by said at least one transverse guide and configured for movement along the transverse direction in and out of the chilled chamber of said cabinet on said at least one transverse guide, said drawer assembly comprising:

at least one vertical guide;

at least one track member carried by said at least one vertical guide and configured for movement along the vertical direction on said at least one vertical guide;

a container supported by said at least one track member; and a biasing member configured for urging said container and said at least one track member upwardly along the vertical direction, said biasing member having a guided end, the guided end of said biasing member configured for sliding between a lifting configuration and a lowering configuration, the guided end of the biasing member positioned higher along the vertical direction when said container is being raised than when said container is being lowered;

wherein, said biasing member exerts sufficient force to lift said container upwardly along the vertical direction when said biasing member is in the lifting configuration; and wherein, said biasing member exerts insufficient force to lift said container upwardly along the vertical direction when said biasing member is in the lowering configuration;

a door mounted to said at least one transverse guide and configured for providing selective access to the chamber of said cabinet, said door extending between a top portion and a bottom portion along the vertical direction; and a latch mechanism comprising a bottom latch positioned at the bottom portion of said door, an upper latch positioned at the top portion of said door and a transfer member, said bottom latch selectively securing said at least one track member and said container in a retracted position, said top latch engaging and selectively securing the guided end of said biasing member when the guided end of said biasing member is in the lifting configuration, said transfer member coupling said upper and lower latches such that said upper and lower latches actuate together.

17. The refrigerator appliance of claim 16, wherein said biasing member comprises at least one of a gas strut, a spring, a linear actuator, and a solenoid.

* * * * *